US009458721B2

(12) United States Patent
Palmer

(10) Patent No.: US 9,458,721 B2
(45) Date of Patent: Oct. 4, 2016

(54) GAS TURBINE ENGINE TIE ROD RETAINER

(75) Inventor: Paul W. Palmer, S. Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1247 days.

(21) Appl. No.: 13/247,280

(22) Filed: Sep. 28, 2011

(65) Prior Publication Data

US 2013/0074518 A1 Mar. 28, 2013

(51) Int. Cl.

| | |
|---|---|
| ***F16B 7/08*** | (2006.01) |
| ***F16B 9/00*** | (2006.01) |
| ***F01D 5/06*** | (2006.01) |

(52) U.S. Cl.

CPC ..... *F01D 5/066* (2013.01); *Y10T 403/335* (2015.01)

(58) Field of Classification Search

CPC ..... H01G 5/06; F01D 5/066; Y10T 403/335
USPC ..... 403/168, 230; 415/142, 210.1, 213.1; 60/797; 411/398; 280/86.753
See application file for complete search history.

(56) References Cited

U.S. PATENT DOCUMENTS

| | | | | | |
|---|---|---|---|---|---|
| 1,785,709 | A | * | 12/1930 | Campau | 411/368 |
| 2,173,667 | A | * | 9/1939 | Slack | 280/86.754 |
| 2,436,313 | A | * | 2/1948 | Lesavoy | 12/116.6 |
| 3,088,279 | A | * | 5/1963 | Diedrich | 60/804 |
| 3,163,441 | A | * | 12/1964 | Traugott | 280/86.753 |
| 3,747,168 | A | * | 7/1973 | Snarskis | 411/349 |
| 3,749,450 | A | * | 7/1973 | Senter et al. | 301/35.631 |
| 4,036,530 | A | * | 7/1977 | Reppert | 301/35.631 |
| 4,979,872 | A | | 12/1990 | Myers | |
| 5,160,251 | A | | 11/1992 | Ciokajlo | |
| 5,452,575 | A | * | 9/1995 | Freid | 60/797 |
| 6,000,906 | A | * | 12/1999 | Draskovich | 415/209.4 |
| 6,267,553 | B1 | | 7/2001 | Burge | |
| 6,709,434 | B1 | * | 3/2004 | Gournay et al. | 606/266 |
| 6,883,303 | B1 | * | 4/2005 | Seda | 60/226.1 |

* cited by examiner

*Primary Examiner* — Daniel P Stodola
*Assistant Examiner* — Nahid Amiri
(74) *Attorney, Agent, or Firm* — Carlson, Gaskey & Olds, P.C.

(57) ABSTRACT

An assembly for use with a gas turbine engine includes a tie rod and a connector. The tie rod, which is for extending radially outwardly from a latitudinal axis of the gas turbine engine, has a hollow length having a longitudinal axis and a base having a width in parallel to the latitudinal axis. The base has a counterbore disposed therein and is wider than a width of the length. The connector, for attaching the base of the tie rod to a bearing assembly of the gas turbine engine, has a hollow body having a shaft removably attaching, at a first end portion thereof, to the counterbore. The shaft and the counterbore are disposed in parallel with the longitudinal axis.

17 Claims, 4 Drawing Sheets

GAS TURBINE ENGINE TIE ROD RETAINER

FIELD OF THE INVENTION

The present invention relates generally to a gas turbine engine and, more particularly, to a rod assembly attaching a bearing assembly to an outer casing.

BACKGROUND

A gas turbine engine of the turbofan type generally includes, from forward to aft a forward fan, a low pressure compressor, a higher pressure compressor, a burner, a high pressure turbine, and an aft low pressure power turbine. The higher pressure compressor and high pressure turbine of the core engine are connected by a first shaft. The low pressure turbine and the fan are connected by a second shaft that rotates with the first shaft that connects the high pressure turbine and the higher pressure compressor. Air passes through the fan, is compressed by the low pressure turbine, is compressed further by the higher pressure turbine, and is mixed with fuel and ignited in the burner. After ignition, the highly energized gas stream expands thereby, in sequence rotating the high pressure turbine to rotate the higher pressure compressor, rotating the low pressure turbine to rotate the fan, and exhausting from the engine.

In a turbofan engine, some thrust is produced by the highly energized gas stream exiting the engine, most of the thrust produced is generated by the forward fan. In a turbojet engine, in contrast, much of an engine thrust is produced by the exiting of the highly energized gas stream.

An engine frame may be used to support the bearings of the engine's turbines. Bearing support frames, however, may be heavy. The frames may also be subject to thermal stresses, thermal gradients and may require heat shields if subjected to hot flow path gases. Other prior art supports use an inner ring structure mounting to an inner annular bearing. The ring structure attaches to a plurality of tie rods that attach to the inner annular ring, an intermediate support structure and an engine casing.

SUMMARY

According to an embodiment disclosed herein, an assembly for use with a gas turbine engine includes a tie rod and a connector. The tie rod, which is for extending radially outwardly from a latitudinal axis of the gas turbine engine, has a hollow length having a longitudinal axis and a base having a width in parallel to the latitudinal axis. The base has a counterbore disposed therein and is wider than a width of the length. The connector, for attaching the base of the tie rod to a bearing assembly of the gas turbine engine, has a hollow body having a shaft removably attaching, at a first end portion thereof, to the counterbore. The shaft and the counterbore are disposed in parallel with the longitudinal axis.

According to a further embodiment disclosed herein, an assembly for use with a gas turbine engine includes a bearing assembly, a tie rod, and a connector. The tie rod, which is for extending radially outwardly from bearing assembly along a longitudinal axis, has a hollow length extending along the longitudinal axis and a base having a width normal to the longitudinal axis. The base has a counterbore disposed therein and the base is wider than a width of the length. The connector, which attaches the base of the tie rod to the bearing assembly, has a hollow body having a shaft removably attaching, at a first end portion thereof, to the counterbore. The shaft and the counterbore are disposed in parallel with the longitudinal axis.

DETAILED DESCRIPTION OF THE PREFERRED EMBODIMENT

Figure 1:
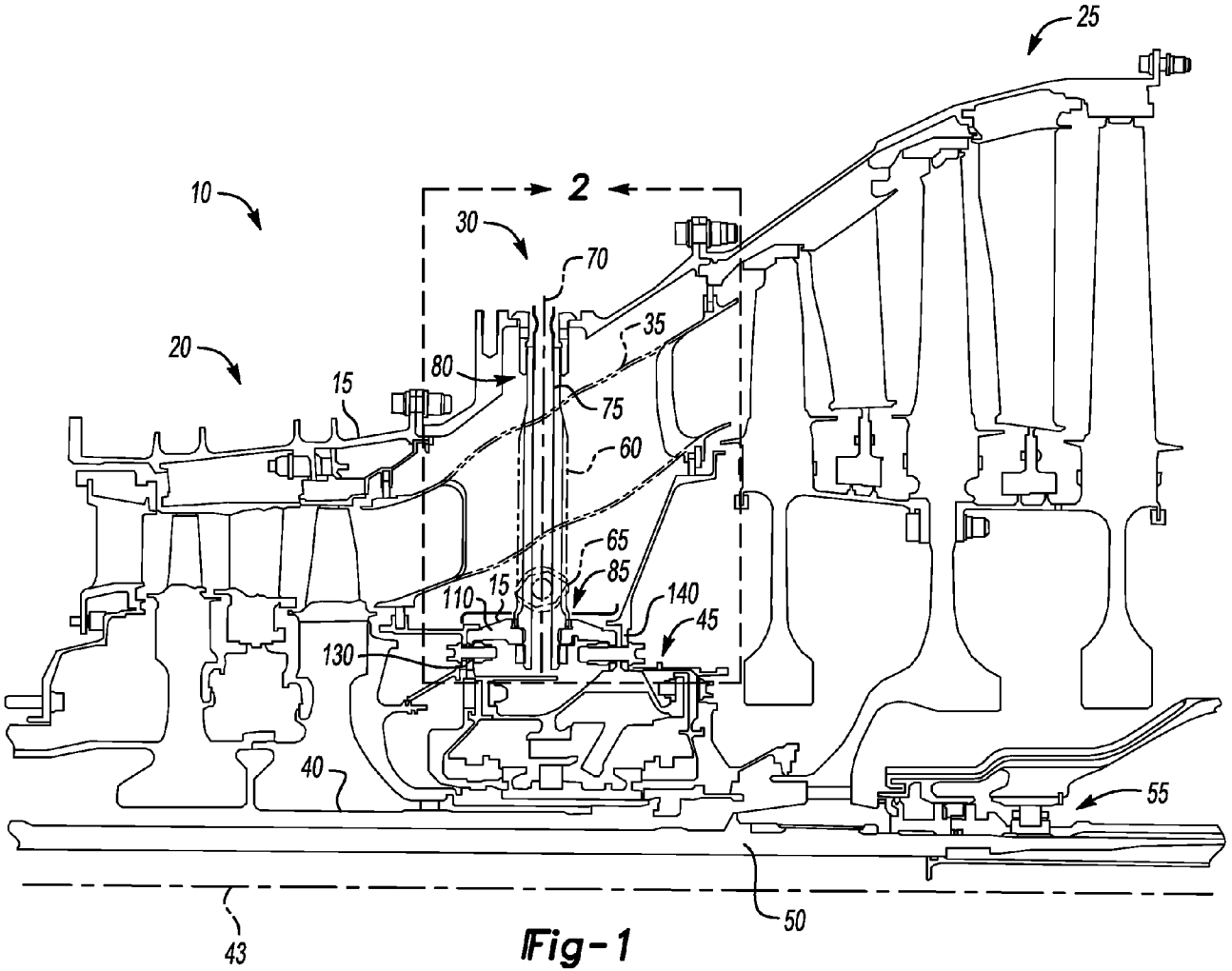
Fig-1 PRIOR ART
FIG. 1 shows a schematic view of a portion of a gas turbine engine having a prior art tie rod attaching a bearing to an engine casing.
Figure 2:
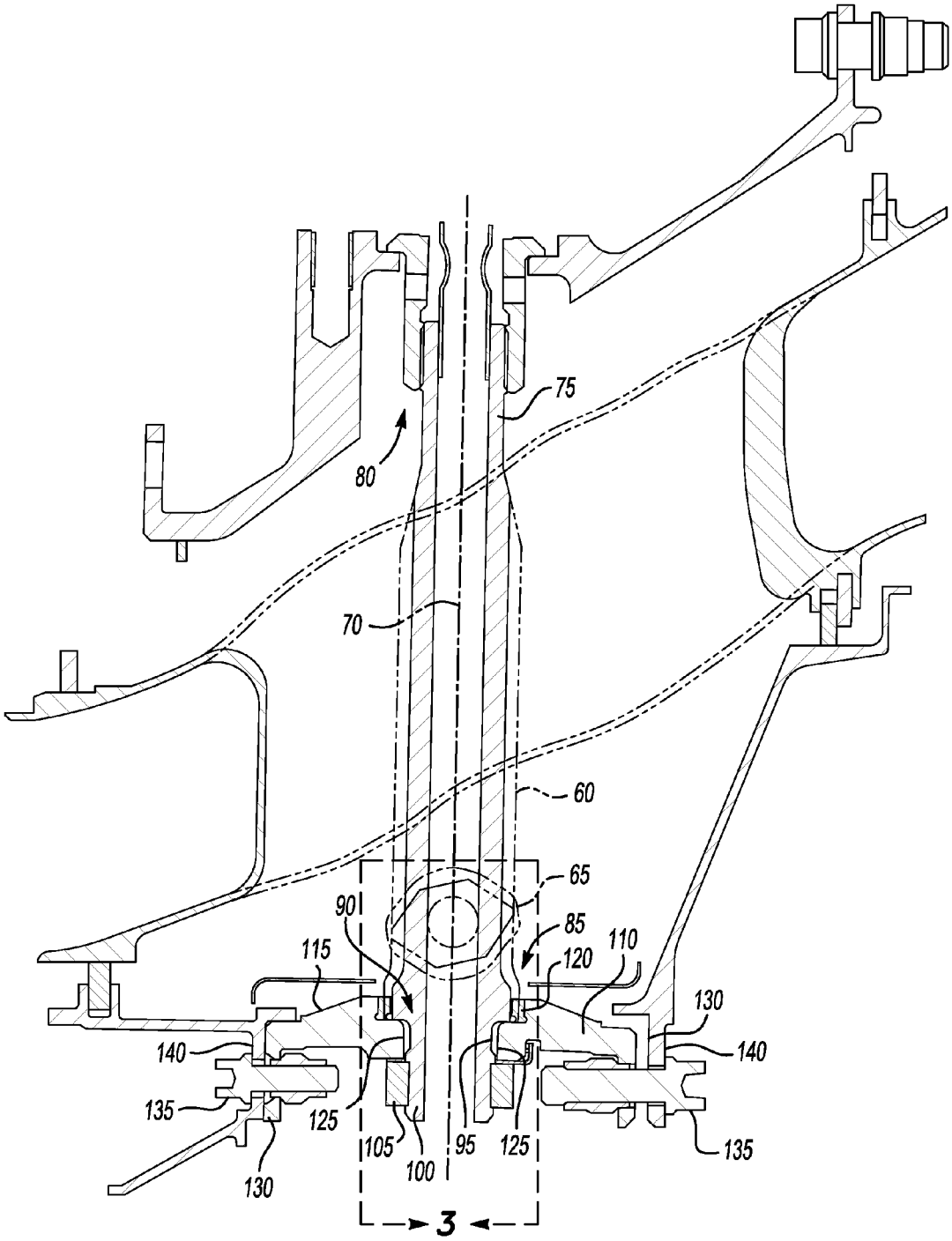
Fig-2 PRIOR ART
FIG. 2 shows a schematic view of a prior art tie rod attaching a bearing to an engine casing, taken along the lines 2-2 of FIG. 1.

Referring now to FIGS. 1 and 2, a gas turbine engine 10 has a casing 15 surrounding a high pressure turbine 20, a low pressure turbine 25 aft of the high pressure turbine 20, and a medium frame 30 disposed there between. A duct 35 transmits high temperature and pressure gases from the high pressure turbine 20 to the low pressure turbine 25 through the medium turbine frame 30. The high pressure turbine 20 connects to a HPT shaft 40 that rotates about a latitudinal axis 43. The HPT shaft 40 is rotatably supported by a HPT bearing assembly 45. The low pressure turbine 25 connects to an LPT shaft 50 that rotates coaxially within the HPT shaft 40. The LPT shaft 50 is rotatably supported by a LPT bearing assembly 55.

A plurality of tie rods 60 are disposed radially about the axis 43 and extend through the conduit duct 35 to attach to the casing 15. Each tie rod 60 has a hexagonally shaped body 65 extending along a longitudinal axis 70. Cooling passageways 75 extend along the axis 70 within the hexagonally shaped body 65 of each tie rod 60. Each tie rod 60 has an upper portion 80 attaching conventionally to the casing 15, and a lower portion 85 having a base 90 that is wider than a length of the tie rod, a narrowed portion 95 disposed radially inward of the base 90, and a threaded portion 100 disposed radially inwardly along axis 70 from the narrowed portion 95 that is connected to the HPT bearing assembly 45 by a nut 105. An example tie rod has a length of about 16 centimeters.

A mounting plate 110 on the HPT bearing assembly 45 has a top surface 115, a hexagonal depression 120 receiving the lower portion 85 of the tie rod 60, an opening for receiving the narrowed portion 95 of the tie rod 60, axially disposed ears 130 that are connected by bolts 135 to the bearing casing 140.

Figure 3:
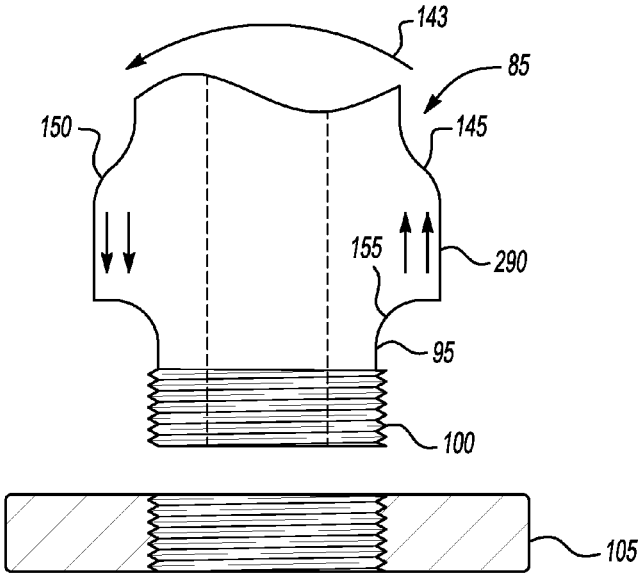
Fig-3 PRIOR ART
FIG. 3 shows a schematic view of a prior art tie rod attaching a bearing to an engine casing, taken along the lines 3-3 of FIG. 2.

Referring now to FIG. 3, a bending moment 143, caused by a reaction between the HPT bearing assembly 45 (and other engine parts and assemblies) and the casing 15 to the propulsive action of the highly energized gas passing from a burner (not shown), may cause a tie rod 60 to wear prematurely. The bending moment 143 on the tie rod 60 may force a forward side 150 of the base 90 downwardly into contact with the mounting plate top surface 115 and cause the aft portion 145 to move upwardly away from the top surface 115. This bending or tilting motion may cause higher stresses on a fillet 155, causing premature wear. Typically, a prior art base has a width along the axis 43 of about 3 cm.

Figure 4:
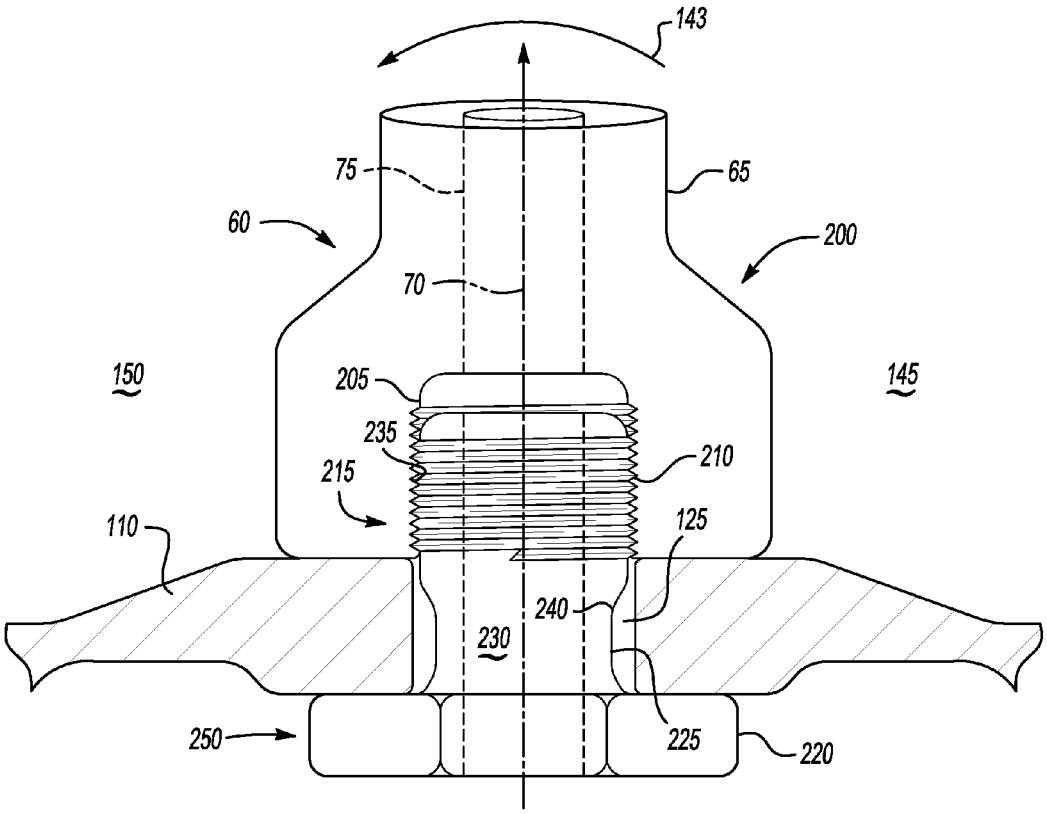
FIG. 4 shows a schematic view of a first embodiment of a bottom area of a tie rod attaching to a bearing assembly.

Referring now to FIG. 4, a tie rod 60 has a widened base 200 that is 30 percent wider than base 290 (see FIG. 3), and a counterbore 205 that is concentric with cooling passageway 75 and axis 70. The counterbore 205 has threads 210 disposed therein for receiving bolt 215. The bolt 215 has a retaining wrenching head 220, a narrowed neck 225 fitting within the opening 125 in the mounting plate 110, a cooling passageway 230 extending through the bolt along axis 70, and threads 235 that cooperate with threads 210 within the counterbore. The widened base 200 resists the bending moment thereby minimizing the tendency of the aft side 145 of the base 220 from lifting off the top surface 115 and minimizing stresses. Moreover, the fillet 155 in the bolt 60 of the prior art is eliminated. The bolt 215 has a fillet 240 between the torque wrenching head 220 and the neck 225 and pretensioning the bolt 215 minimizes stresses thereupon. The widened base 200 has a width along the axis 43 of about 3.9 cm wherein a ratio of the width to a length of the tie rod 60 is 0.20:1 or greater. The widened base 200, disposed in parallel to axis 43, is bisected by the latitudinal axis 70.

Figure 5:
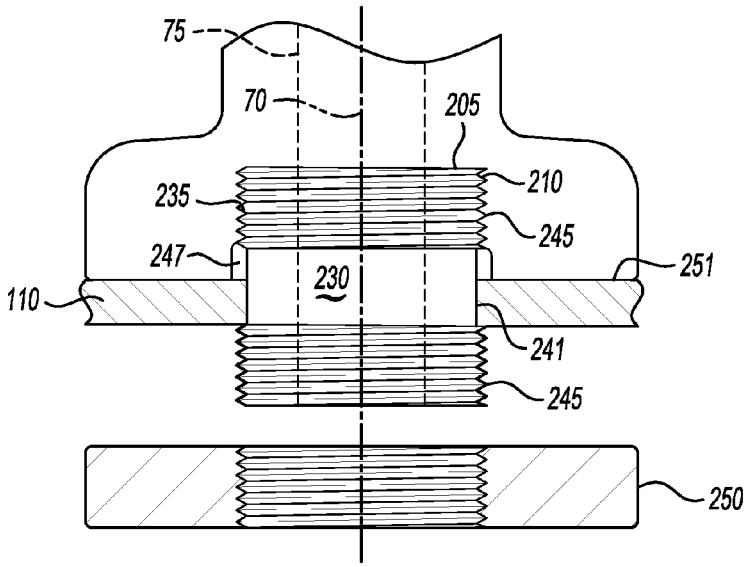
FIG. 5 shows a schematic view of a second embodiment of a bottom area of a tie rod attaching to a bearing assembly.

Referring now to FIG. 5, an alternative to the bolt 215 is shown. A nipple 241 is provided with nut bolt threads 245, instead of a torque wrenching head, to secure the nipple behind the mounting plate 110. The threads 210 in the counterbore do not extend to a bottom 251 of the tie rods thereby creating an offset 247 in the counterbore to allow for stretch of the bolt nipple 241. Such stretch helps minimize the bending moment on the tie rod 60. The nipple 241 is screwed into the counter bore 205 place through the mounting plate 110 and secured by nut 250.

Figure 6:
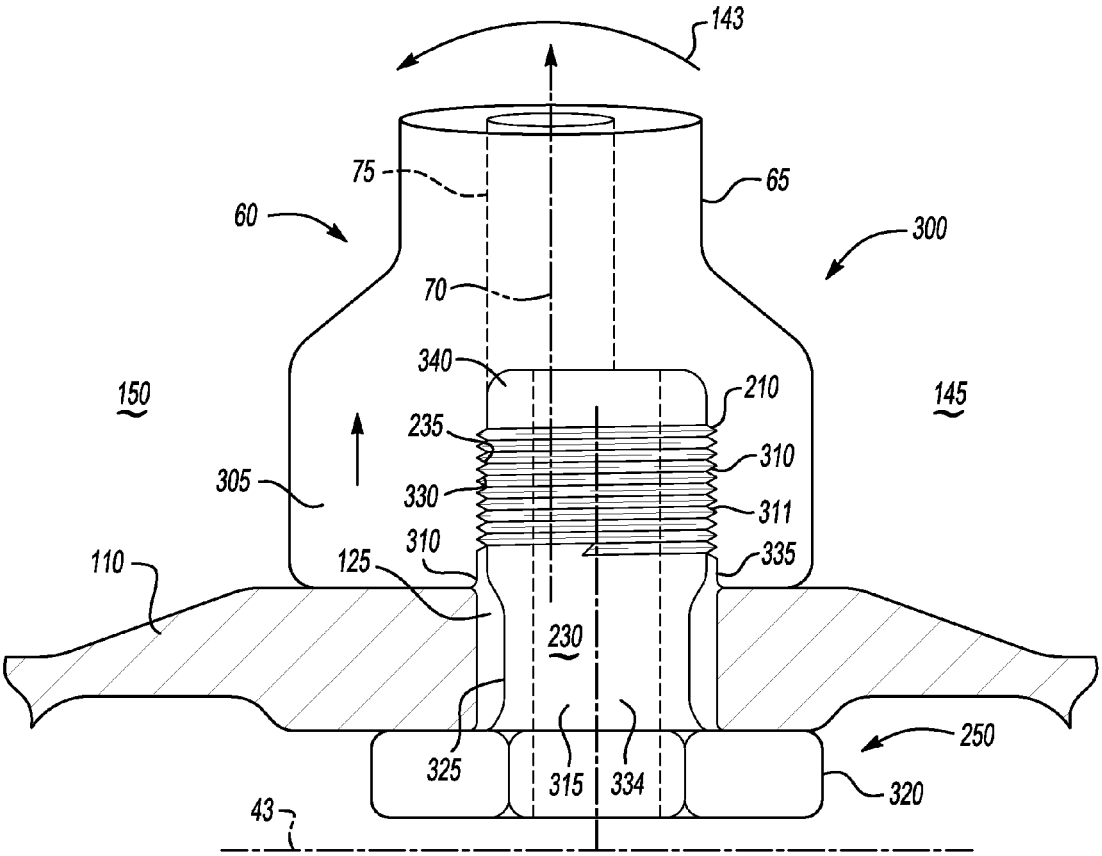
FIG. 6 shows a schematic view of a third embodiment of a bottom area of a tie rod attaching to a bearing assembly.

Referring now to FIG. 6, the base 300 of the tie rod 60 is widened about 40% percent bigger than the widened base 290 (see FIG. 3), and has a thickened, eccentric portion 305 extending forward along axis 43 in opposition to the bending moment 143 causing the base 300 to form an eccentrically shape. The counterbore 310 is offset from the cooling passageway 75 and axis 70 towards the aft side 145. The counterbore has threads 311 therewithin. A bolt 315 has a retained wrench head 320, a narrowed neck 325 inserted in opening 125, and bolt threads 330 cooperating with threads 311 to anchor the bolt 315 within the counterbore 310. As with FIG. 5, there is an offset 335 relative to the counterbore and the bolt 300 to allow for stretch. A cavity 340 is placed in the counterbore 310 between the bolt and the cooling passageway 75 to connect the cooling passage 230 that is offset from the cooling passageway 75 to allow for cooling of the tie rod 60. One of ordinary skill in the art will recognize that the nipple and the nut 250 may be used to substitute for the bolt 315. The widened base 200 has a width along the axis 43 of about 4.2 cm wherein a ratio of the width to length of the tie rod 60 is 0.25:1 or greater. The widened base 300, disposed in parallel to axis 43, is not bisected by the latitudinal axis 70 because the thickened portion 305 is wider than the other side 307 of the base 300.

While the present invention has been described with reference to a particular preferred embodiment and by accompanying drawings, it would be understood by those in the art that the invention is not limited to the preferred embodiment and that various modification and the like could be made thereto without departing from the scope of the invention as defined in the following claims:

What is claimed is:

1. An assembly for use with a gas turbine engine, said assembly comprising:

a tie rod for extending radially outwardly from a latitudinal axis of said gas turbine engine said tie rod having:

a body including a width and a length extending along a central longitudinal axis, said longitudinal axis extends through a cooling passage in said tie rod;

a base having a width parallel to said latitudinal axis, said base having a counterbore disposed therein, wherein said base is wider than a width of said body and said counterbore is not coaxial with said longitudinal axis; and a first connector for attaching an opposite side of said base from said tie rod to a bearing assembly of said gas turbine engine, said connector having:

a connector body having a shaft removably attaching, at a first end portion thereof, to said counterbore, wherein said shaft and said counterbore are disposed in parallel with said longitudinal axis.

2. The assembly of claim 1 wherein said width parallel to said latitudinal axis of said base is bisected by said longitudinal axis.

3. The assembly of claim 1 wherein said width parallel to said latitudinal axis of said base is offset from said longitudinal axis to offset a bending moment on said tie rod.

4. The assembly of claim 3 wherein said counterbore is offset from said longitudinal axis.

5. The assembly of claim 3 wherein an area between said shaft and a length of a hollow portion of said tie rod within said base allows cooling air to flow therethrough.

6. The assembly of claim 1, wherein said counterbore is offset with said longitudinal axis through said cooling passage.

7. The assembly of claim 1, further comprising a cavity between said first connector and said cooling passage.

8. The assembly of claim 1, wherein said base includes an eccentric portion at least partially defined by said counterbore.

9. The assembly of claim 1, wherein said first connector includes a bolt having a head for engaging said bearing assembly and said bolt includes a threaded portion spaced from said head by a narrowed neck.

10. An assembly for use with a gas turbine engine, said assembly comprising:

a bearing assembly;

a tie rod for extending radially outwardly from said bearing assembly along a central longitudinal axis, said tie rod having:

a body including a hollow length extending along said longitudinal axis said longitudinal axis extends through a cooling passage in said tie rod, a base having a width normal to said longitudinal axis, said base having a counterbore disposed therein, wherein said base is wider than a width of said body and the counterbore is not coaxial with said longitudinal axis, and a first connector attaching said base of said tie rod to said bearing assembly, said connector having:

a hollow body having a shaft removably attaching, at a first end portion thereof, to said counterbore, wherein said shaft and said counterbore are disposed in parallel with said longitudinal axis.

11. The assembly of claim 10 wherein a ratio of said base of said tie rod to a length of said tie rod is greater than 0.25:1.

12. The assembly of claim 10 wherein said width parallel to a latitudinal axis of said base is bisected by said longitudinal axis.

13. The assembly of claim 10 wherein said width of said base is offset from said longitudinal axis and has a thicker portion to offset a bending moment on said tie rod.

14. The assembly of claim 10, wherein said longitudinal axis extends through a cooling passage in said tie rod and said counter bore is offset with said longitudinal axis of said cooling passage in an axial direction of said gas turbine engine.

15. The assembly of claim 10, wherein said base includes an eccentric portion at least partially defined by said counterbore.

16. The assembly of claim 10, wherein said first connector includes a bolt having a head for engaging said bearing assembly and said bolt includes a threaded portion spaced from said head by a narrowed neck.

17. The assembly of claim 10, wherein said first connector includes a bolt having a head located on a first side of said bearing assembly and said tie rod is located on a second side of the bearing assembly from said head of said bolt.

* * * * *